US009512751B2

(12) United States Patent
Jo et al.

(10) Patent No.: US 9,512,751 B2
(45) Date of Patent: Dec. 6, 2016

(54) DEVICE AND METHOD FOR REDUCING FUEL DILUTION OF DIESEL ENGINE

(71) Applicant: Hyundai Motor Company, Seoul (KR)

(72) Inventors: Won Jin Jo, Hwaseong-Si (KR); Jae Deuk Lee, Hwaseong-Si (KR); Je Rok Chun, Hwaseong-Si (KR); Dae Kwon Kim, Suwon-Si (KR); Young Jic Kim, Hwaseong-Si (KR); Jung Hwan Ham, Suwon-Si (KR); Jin Seok Chang, Seongnam-Si (KR)

(73) Assignee: Hyundai Motor Company, Seoul (KR)

( * ) Notice: Subject to any disclaimer, the term of this patent is extended or adjusted under 35 U.S.C. 154(b) by 62 days.

(21) Appl. No.: 14/569,324

(22) Filed: Dec. 12, 2014

(65) Prior Publication Data

US 2016/0084126 A1 Mar. 24, 2016

(30) Foreign Application Priority Data

Sep. 22, 2014 (KR) ..... 10-2014-0125705

(51) Int. Cl.

| | |
|---|---|
| ***F02M 5/00*** | (2006.01) |
| ***F01M 5/00*** | (2006.01) |
| *F01M 5/02* | (2006.01) |
| *F01M 5/04* | (2006.01) |

(52) U.S. Cl.

CPC ..... *F01M 5/001* (2013.01); *F01M 5/007* (2013.01); *F01M 5/04* (2013.01); *F01M 2005/023* (2013.01)

(58) Field of Classification Search

CPC ..... F01M 5/001; F01M 5/007; F01M 5/04; F01M 2005/023

USPC ..... 123/196 R, 196 AB, 196 S, 196 A

See application file for complete search history.

(56) References Cited

U.S. PATENT DOCUMENTS

| | | | | |
|---|---|---|---|---|
| 2007/0057675 | A1* | 3/2007 | Yamane et al. | 324/438 |
| 2008/0053217 | A1* | 3/2008 | Nishio et al. | 73/291 |
| 2011/0000835 | A1* | 1/2011 | Geiger | 210/149 |
| 2012/0042845 | A1* | 2/2012 | Kanai | 123/196 AB |

FOREIGN PATENT DOCUMENTS

| | | | |
|---|---|---|---|
| JP | 06-212934 | A | 8/1994 |
| JP | 2004-190513 | | 7/2004 |
| JP | 2004-293394 | A | 10/2004 |
| JP | 2008-121468 | A | 5/2008 |
| JP | 2009-270546 | A | 11/2009 |
| JP | 2010-84536 | A | 4/2010 |
| KR | 1998-0022465 | | 7/1999 |
| KR | 10-2008-0003852 | | 1/2008 |

* cited by examiner

*Primary Examiner* — Marguerite McMahon

(74) *Attorney, Agent, or Firm* — Morgan, Lewis & Bockius LLP

(57) ABSTRACT

A device for reducing fuel dilution of a diesel engine may include an engine oil level sensor mounted to an oil pan for storing engine oil, to sense a level of the engine oil, a heater switch switched on by a signal of a controller, when the level of the engine oil in the oil pan is increased to a reference level or more by fuel diluted in the engine oil, and a heater connected to the heater switch in the oil pan, to evaporate the fuel diluted in the engine oil while being operated by an on state of the heater switch.

6 Claims, 3 Drawing Sheets

DEVICE AND METHOD FOR REDUCING FUEL DILUTION OF DIESEL ENGINE

CROSS-REFERENCE TO RELATED APPLICATION

The present application claims priority to Korean Patent Application No. 10-2014-0125705 filed Sep. 22, 2014, the entire contents of which is incorporated herein for all purposes by this reference.

BACKGROUND OF THE INVENTION

1. Field of the Invention

The present disclosure relates to a device and a method for reducing fuel dilution of a diesel engine. More particularly, it relates to a device and a method for reducing fuel dilution of a diesel engine, which can prevent an engine oil dilution phenomenon in which fuel is mixed with engine oil in a diesel engine having a diesel particulate filter trap (DPF) mounted therein.

2. Description of Related Art

In general, a diesel engine vehicle discharges particulates, and hence an aftertreatment device is mounted in the diesel engine vehicle in order to reduce the particulates. The representatives of the aftertreatment device are a diesel particulate filter trap (DPF), a diesel oxidation catalyst (DOC), and the like.

The DPF is a particulate material reduction technique that is currently most efficient and approaches commercialization. The particulate material reduction technique is a technique of collecting particulates discharged from a diesel engine using a DPF filter and then burning (regenerating) the collected particulates, and again collecting particulates to be continuously used. The DPF can reduce particulates up to 80% or more, which has a very excellent advantage in terms of its performance. However, the durability and economy of the DPF act as obstacles against commercialization.

As particulates are collected in the DPF filter, a back-pressure is applied to the engine, and the output and fuel consumption rate of the engine is slightly decreased by the back-pressure. Therefore, it is required to complement a technique for minimizing this.

The DPF technique is generally divided into a PM collection technique and a filter regeneration technique. The DPF technique is basically configured with three parts, i.e., a filter, a regeneration device and a control device.

In order to regenerate the DPF, it is important to increase exhaust temperature up to 650 that is a DPF activation temperature. Accordingly, the DPF activation temperature can be maintained through post injection in which the fuel injection in a combustion chamber is performed after top dead center (ATDC). The ATDC is to delay ignition delay time, and means before and after top dead center (to close intake and exhaust valves before and after top dead center).

In order to regenerate the DPF, it is important to start DPF regeneration by increasing the temperature of the DPF up to the DPF activation temperature. As a plan for always maintaining a constant temperature during the regeneration of the DPF, an oxidation reaction occurs inside the DPF through the post injection.

Meanwhile, if fuel is injected at the time when a piston of the engine descends toward a bottom dead center, the injected fuel flows up to the inside of the DPF through the exhaust valve. Therefore, an engine oil dilution phenomenon occurs in which, when the piston descends toward the bottom dead center except the purpose of maintaining the DPF activation temperature, the injected fuel that exists on the wall surface of a cylinder in a non-combustion state is naturally mixed with engine oil through a piston ring.

If the engine oil is returned to an oil pan by circulation of the engine oil in the state in which the fuel is diluted by the engine oil, the fuel exists in the oil pan while being diluted by the engine oil.

In the current manner that the DPF is regenerated through the post injection, the engine oil dilution phenomenon has bad influence on cooling of various engine components and lubricant. In addition, a dieseling phenomenon is caused in which the engine oil is flowed in the combustion chamber and then burnt. As a result, there is a problem in that the durability of the engine is deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a device and a method for reducing fuel dilution of a diesel engine, in which fuel in engine oil is evaporated by operating a heater built in an oil pan according to an amount of particulates accumulated for each operating condition, a regeneration period change based on the amount, and an amount of diluted oil based on a post injection amount, so that it is possible to reduce dilution of the engine oil.

According to various aspects of the present invention, a device for reducing fuel dilution of a diesel engine may include an engine oil level sensor mounted to an oil pan for storing engine oil, to sense a level of the engine oil, a heater switch switched on by a signal of a controller, when the level of the engine oil in the oil pan is increased to a reference level or more by fuel diluted in the engine oil, and a heater connected to the heater switch in the oil pan, to evaporate the fuel diluted in the engine oil while being operated by an on state of the heater switch.

The heater switch may be employed as a bimetal switch that is turned off at a predetermined temperature or more.

A barrier for storing a small amount of engine oil to be heated may be integrally formed with the oil pan on one wall surface of the oil pan, to which the heater switch and the heater are mounted.

A height of the barrier may be formed equal to the reference level of the engine oil.

According to various aspects of the present invention, a method for reducing fuel dilution of a diesel engine may include measuring, by an engine oil level sensor, a level of engine oil in an oil pan, turning on a heater switch in the oil pan, by a controller, when the level of the engine oil is measured to be a reference level or more, and evaporating and removing fuel diluted in the engine oil as a heater in the oil pan is operated by an on state of the heater switch.

The method may further include allowing the engine oil to be flowed in the engine through a blow-by pipe, after the fuel in the engine oil is evaporated and removed.

The method may further include turning off the heater switch, by the controller, when the temperature of the engine oil is increased to a reference temperature or more.

The heater switch may be employed as a bimetal switch that is turned off at the reference temperature or more.

Other aspects and preferred embodiments of the invention are discussed infra.

The present invention provides advantages as follows.

First, when the fuel in the engine oil stored in the oil pan is diluted the fuel in the engine oil can be evaporated by operating the heater, so that it is possible to reduce dilution of the engine oil.

Second, the dilution of the engine oil is prevented, so that it is possible to prevent a dieseling phenomenon in which the engine oil is flowed in a combustion chamber and then burnt, and the like.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1A:
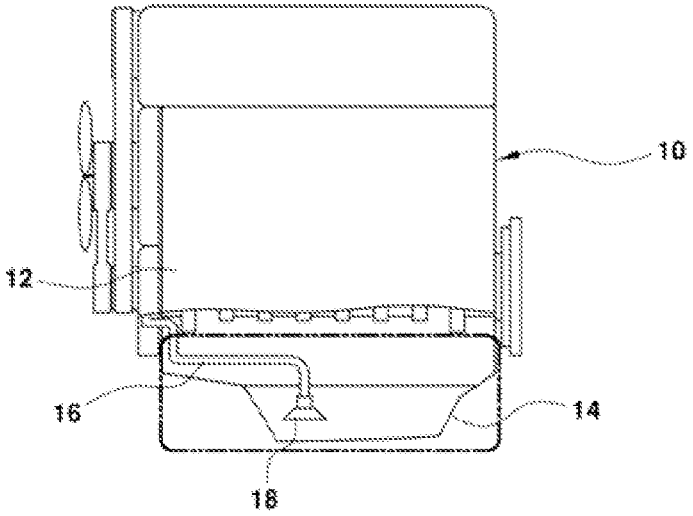
FIG. 1A, FIG. 1B and FIG. 1C are schematic views illustrating an exemplary device for reducing fuel dilution of a diesel engine according to the present invention.
Figure 1B:
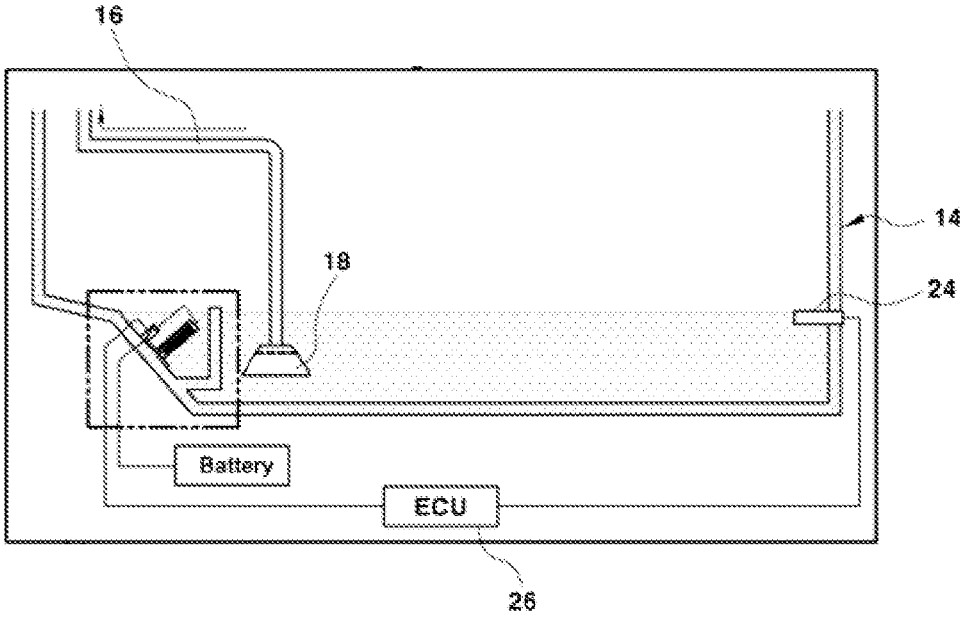
Figure 1C:
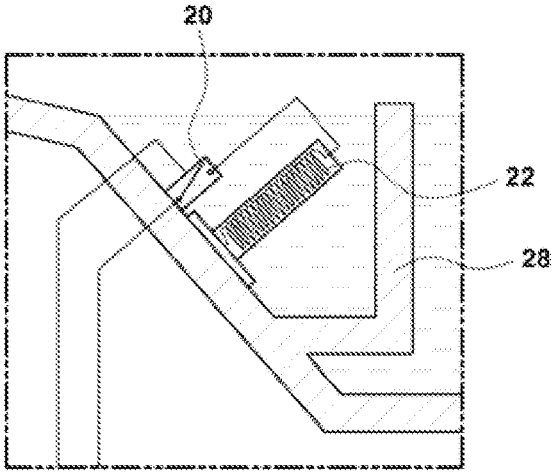
Figure 2:
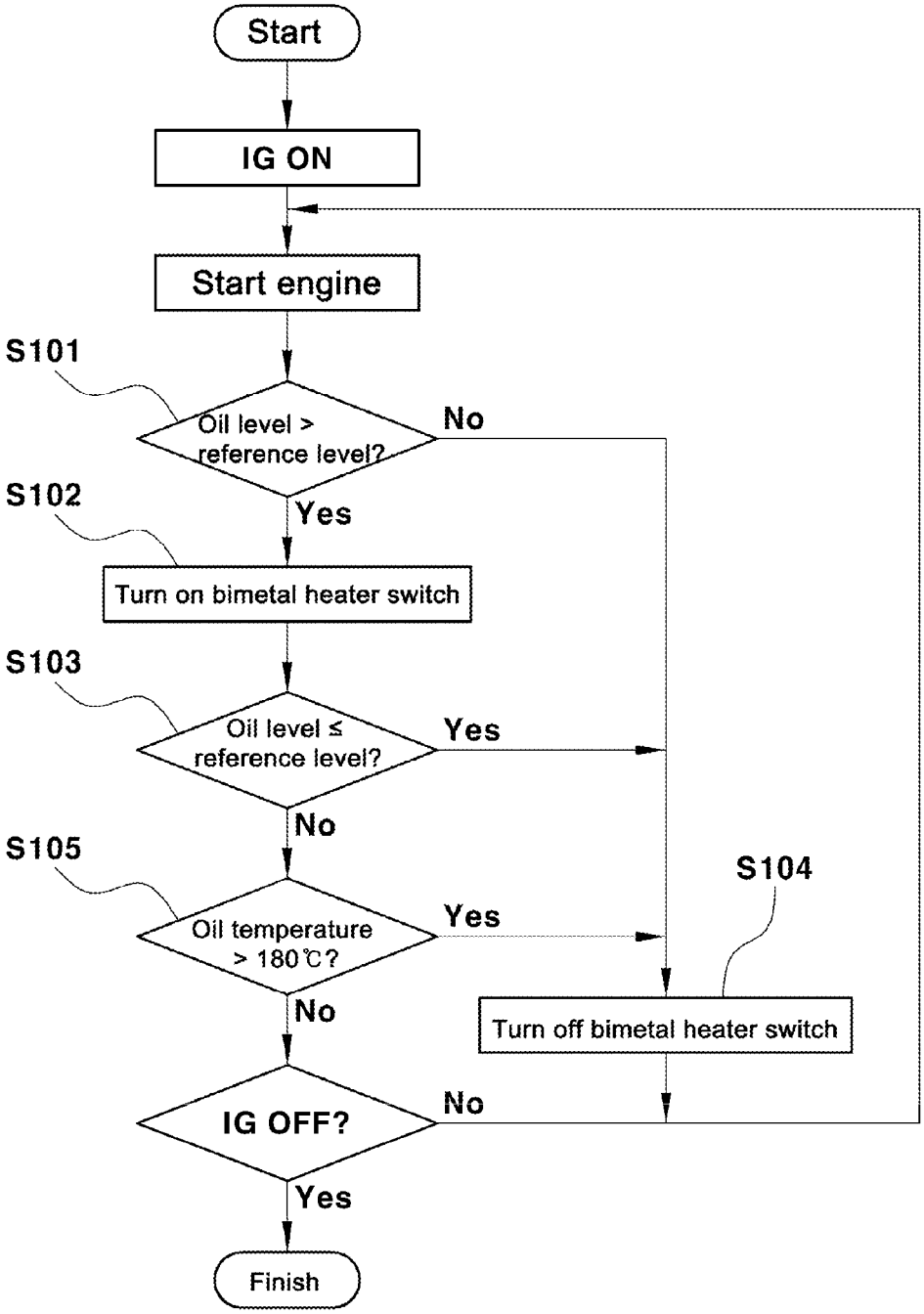
FIG. 2 is a flowchart illustrating an exemplary method for reducing fuel dilution of a diesel engine according to the present invention.

FIG. 1A, FIG. 1B and FIG. 1C are schematic views illustrating a device for reducing fuel dilution of a diesel engine according to various embodiments of the present invention.

As shown in FIG. 1A, FIG. 1B and FIG. 1C, an oil pan 14 for storing engine oil is mounted at a lower portion of a cylinder block 12 of the diesel engine 10, and an oil supply line 16 connected to an oil pump provided at one side of the cylinder block 12 is inserted into the oil pan 14. In addition, a strainer 18 for filtering foreign matters when oil in the oil pan 14 is supplied toward the engine is mounted at the bottom end of the oil supply line 16.

Thus, when the engine is driven, the engine oil in the oil pan 14 is circulated to each perturbation part of the engine by passing through the strainer 18 and the oil supply line 16 by means of the pumping force of the oil pump, so that the lubrication and cooling of the engine occurs. Accordingly, smooth operations of components constituting friction and perturbation parts of the engine are made.

In this state, an engine oil dilution phenomenon occurs in which, if fuel is injected at the time when a piston of the engine descends toward a bottom dead center in order to increase the temperature of a diesel particulate filter trap (DPF) up to an activation temperature for the purpose of regeneration of the DPF, the injected fuel that exists on the wall surface of a cylinder in a non-combustion state is naturally mixed with engine oil through a piston ring.

If the engine oil is returned to an oil pan by circulation of the engine oil in the state in which the fuel is diluted by the engine oil, the fuel exists in the oil pan while being diluted by the engine oil, and continuously circulates, together with the engine oil, each perturbation part of the engine, and the like.

The engine oil dilution phenomenon has bad influence on cooling of various engine components and lubricant. In addition, a dieseling phenomenon is caused in which the engine oil is flowed in a combustion chamber and then burnt. As a result, there is a problem in that the durability of the engine is deteriorated.

Accordingly, the present invention provides a device and a method for reducing fuel dilution of a diesel engine, in which fuel existing in an oil pan due to the engine oil dilution phenomenon is removed, so that it is possible to prevent, in advance, the durability of the engine from being deteriorated due to the engine oil dilution phenomenon.

Referring to FIG. 1A, FIG. 1B and FIG. 1C, the device of the present invention is configured to include an engine oil level sensor 24 mounted to the oil pan 14 for storing engine oil, to sense a level of the engine oil; a heater switch 20 switched on by a signal of a controller 26, when the level of the engine oil in the oil pan 14 is increased to a reference level or more by the fuel dilution; and a heater 22 mounted to be connected to the heater switch 20 in the oil pan 14, to evaporate fuel diluted in the engine oil while being operated by the on state of the heater switch 20.

The engine oil level sensor 24 is a sensor for measuring a level of the engine oil in the oil pan 14. As the fuel is diluted in the engine oil in the oil pan 14 due to the engine oil dilution phenomenon described above, the engine oil level sensor 24 senses that the level of the engine oil is changed into the reference level or more, and transmits a sensing signal to the controller.

At a predetermined temperature or less, the heater switch 20 is conductably connected to a contact point connected to the heater by the signal of the controller 26. At the predetermined temperature or more, the heater switch 20 is employed as a bimetal switch separated from the contact point while being bent.

In this state, the bimetal switch is a switch formed by bonding two kinds of thin metal plates of which thermal expansion coefficients are very different from each other. At the predetermined temperature or more, the metal plate having large thermal expansion coefficient is bent toward the opposite metal plate while being further expanded. At the predetermined temperature or less, the bimetal switch returns to the original state.

The heater 22 is connected to the heater switch 20 in the oil pan 14, to evaporate fuel diluted in the engine oil by heating the engine oil.

Thus, the heater switch 20, i.e., the bimetal switch is conductably connected to the contact point connected to the heater by the signal of the controller 26, to supply power of a battery to the heater. If the temperature of the oil becomes a predetermined temperature or more as the engine is driven, the bimetal switch is separated from the contact point connected to the heater so that the power of the battery is no longer supplied to the heater 22.

Meanwhile, a barrier 28 for storing a small amount of engine oil to be heated while covering the heater switch 20 and the heater 22 is integrally formed with the oil pan 14 on one wall surface of the oil pan 14, to which the heater switch 20 and the heater are mounted.

The barrier 28 forms a space in which a small amount of engine oil is stored, so that the heater 22 positioned in the space of the barrier 28 can be employed as a power-saving compact heater for heating only the small amount of engine oil.

In this state, the height of the barrier 28 is formed equal to the reference level of the engine oil, so that engine oil of the reference level or more due to fuel dilution can flow over the barrier 28 to be filled in the space of the barrier 28.

Hereinafter, a method for reducing fuel dilution of the diesel engine configured as described above will be described as follows.

As described above, an engine oil dilution phenomenon occurs in which fuel is diluted in engine oil due to post injection for generating the DFP, etc., and therefore, the level of the engine oil in the oil pan may increase as high as the amount of the diluted fuel.

In this state, the engine oil level sensor 24 mounted to the oil pan 14 measures a level of the engine oil and transmits the measured level to the controller 26.

Subsequently, the controller 26 decides whether the level of the engine oil is the reference level or more (S101).

If it is decided that the level of the engine oil is the reference level or more, the controller 26 controls the heater switch 20, i.e., the bimetal switch to be turned on (S102).

Subsequently, the bimetal switch is conductably connected to the contact point connected to the heater by a signal of the controller 26, so that the power of the battery is supplied to the heater 22.

In this state, the level of the engine oil in the oil pan increases as much as the amount of the diluted fuel, and therefore, the engine oil flows over the barrier 28 to be filled in the space of the barrier 28.

Thus, the heater 22 is operated to heat the engine oil, and simultaneously, the engine oil in the space of the barrier 28 is heated up to about 150. Accordingly, the fuel diluted in the engine oil is evaporated, and the evaporated fuel is guided to the combustion chamber of the engine through a blow-by pipe to be burnt.

Meanwhile, the engine oil in the space of the barrier 28 is occasionally diluted with oil in the oil pan 14 by movement of a vehicle, and the fuel is evaporated due to heating. Therefore, the amount and dilution of the entire engine oil in the oil pan are decreased. Accordingly, the controller 26 decides whether the level of the engine oil in the oil pan is lowered to the reference level, based on a sensing signal of the engine oil level sensor 24 (S103).

If it is decided that the level of the engine oil in the oil pan is lowered to the reference level, the controller 26 controls the heater switch 20 to be turned off (S104).

In order to prevent a fire from occurring due to overheat caused by an abnormal operation during the heating of the engine oil, if the temperature of the engine oil becomes a predetermined temperature (about 180) or more (S105), the power supply to the heater is interrupted by a proper operation of the bimetal switch.

That is, if the temperature of the engine oil becomes the predetermined temperature (about 180) or more due to overheat caused by an abnormal operation during the heating of the engine oil or continuous driving of the engine, the heater switch 20, i.e., the bimetal switch is separated from the contact point connected to the heater while being bent due to a difference in thermal expansion coefficient between the two metal plates constituting the bimetal switch, so that the power of the battery is no longer supplied to the heater 22.

As described above, when the fuel in the engine oil stored in the oil pan is diluted, the heater is operated to evaporate the fuel in the engine oil, so that it is possible to reduce dilution of the engine oil. Further, it is possible to prevent the dieseling phenomenon in which the engine oil is flowed in the combustion chamber and then burnt, and the deterioration of the durability of the engine.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A device for reducing fuel dilution of a diesel engine, the device comprising:

an engine oil level sensor mounted to an oil pan for storing engine oil, to detect a level of the engine oil;

a heater switch switched on by a signal of a controller, when the level of the engine oil in the oil pan is increased to a reference level or more by fuel diluted in the engine oil; and a heater connected to the heater switch in the oil pan, to evaporate the fuel diluted in the engine oil while being operated by an on state of the heater switch, wherein a barrier for storing a predetermined amount of the engine oil to be heated is integrally fixed with the oil pan on a wall surface of the oil pan to which the heater switch and the heater are mounted, and wherein a height of the barrier is equal to the reference level of the engine oil.

2. The device of claim 1, wherein the heater switch is employed as a bimetal switch turned off at a predetermined temperature or more.

3. A method for reducing fuel dilution of a diesel engine, the method comprising:

measuring, by an engine oil level sensor, a level of engine oil in an oil pan;

turning on a heater switch in the oil pan, by a controller, when the level of the engine oil is measured to be a reference level or more; and evaporating and removing fuel diluted in the engine oil as a heater in the oil pan is operated by an on state of the heater switch, wherein a barrier for storing a predetermined amount of engine oil to be heated is integrally fixed with the oil pan on a wall surface of the oil pan, to which the heater switch and the heater are mounted, and wherein a height of the barrier is qual to the reference level of the engine oil.

4. The method of claim 3, further comprising, after the fuel in the engine oil is evaporated and removed from the oil pan, allowing the evaporated fuel to flow in the engine.

5. The method of claim 3, further comprising turning off the heater switch, by the controller, when a temperature of the engine oil is increased to a reference temperature or a higher temperature.

6. The method of claim 5, wherein the heater switch is employed as a bimetal switch turning off at the reference temperature or a higher temperature.

* * * * *